United States Patent [19]

Schmidt et al.

[11] Patent Number: 4,802,603

[45] Date of Patent: Feb. 7, 1989

[54] EASY OPEN CAN END

[75] Inventors: Gunter H. R. Schmidt; Hans-Dieter Joge; Wilhelm R. Sauer, all of Neuwied, Fed. Rep. of Germany; Abraham C. Spruit, Beverwijk, Netherlands

[73] Assignee: The Broken Hill Proprietary Company Limited, Victoria, Australia

[21] Appl. No.: 121,640

[22] Filed: Nov. 16, 1987

[30] Foreign Application Priority Data

Nov. 17, 1986 [DE] Fed. Rep. of Germany ..... 3639426

[51] Int. Cl.[4] ..... B65D 41/32

[52] U.S. Cl. ..... 220/268; 413/12; 413/15

[58] Field of Search ..... 220/268, 66; 413/12, 413/15, 17

[56] References Cited

U.S. PATENT DOCUMENTS

| | | | |
|---|---|---|---|
| 3,972,445 | 8/1976 | Debenham | 220/268 |
| 4,054,228 | 10/1977 | Balocca et al. | 220/268 |
| 4,128,186 | 12/1978 | Gane | 220/268 |
| 4,134,517 | 1/1979 | Rhoades | 220/268 |
| 4,196,823 | 4/1980 | Madden et al. | 220/268 |
| 4,311,249 | 1/1982 | Joyce | 220/268 |
| 4,319,692 | 3/1982 | Gundlach | 220/268 |

*Primary Examiner*—George T. Hall

*Attorney, Agent, or Firm*—Armstrong, Nikaido, Marmelstein & Kubovcik

[57] ABSTRACT

A can end (1) made from metal for cans whose contents is under inside pressure is provided with at least one opening tab (4) partly punched from the end leaving a hinge area (6) and a relative aperture (2) formed by the partial punching, with the opening tab (4) and/or the area of the end surrounding the aperture (2) being cold formed so that the edge area (8) of aperture (2) covers the edge area (4*a*) of opening tab (4) on the end outside (1*a*). On the end inside (1*b*), plastisol (10) is applied in ring-form to the edge areas (4*a*, 8) of opening tab (4) and of aperture (2) and jellied under heating. Before its application and gelation respectively, the plastisol (10) has a viscosity $\eta_{D4441s}-1$ (40° C.) of about 2000–2800 mPa.s, and an edge angle $\alpha$ of about 0.4–1.0 N/mm$^2$, and a maximum elongation of 120–250%.

26 Claims, 2 Drawing Sheets

EASY OPEN CAN END

Figure 1:
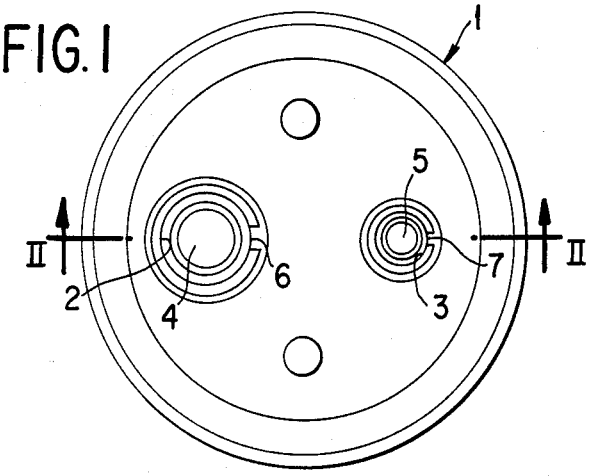

The invention relates to a can end made from metal for cans, whose contents is under inside pressure, specifically for cans to be filled with carbonated beverages, with at least one opening tab partially punched from the end with a remaining hinge area and a matching aperture formed by the partial punching of the opening tab, with the opening tab and/or the area of the end surrounding the aperture being cold formed so that the edge area of the aperture overlaps the edge area of the opening tab on the outside of the end, and with plastisol being applied as a sealant in ring-form to the edge areas of the opening tab and of the aperture on the end inside and being jellied under the influence of heat.

Furthermore, the invention relates to a method of producing such a can end.

For a known can end of this type made from metal (GB PS No. 1 532 751), the plastisol used shall have a tensile strength of about 1.8 to 2.9 N/mm$^2$ and a maximum elongation of 275 to 375%, hereby intending to obtain an initial opening force, which is required to push the opening tab to the inside of the container, simultaneously tearing off the plastisol sealing, of about 44 to 89 N, preferably about 58 to 76 N. However, such can ends as known are not suitable for cans whose contents is under inside pressure, especially not for cans for carbonated beverages.

In these cans, the opening tab is also under inside pressure. In pushing the opening tab to the container inside, this pressure must first be overcome, and, simultaneously, the plastisol sealing must be torn. So, the total opening force is composed of the force which is needed for tearing the plastisol sealing without inside pressure and of the force acting on the opening tab due to the inside pressure.

It is important for can ends to be used for cans whose contents is under inside pressure that the plastisol sealing remains leak-proof over an extended time. To this purpose, the plastisol sealing should have a sufficient thickness and be free of air inclusions. But, the plastisol sealing cannot be applied in any arbitrary thickness, as this would, in turn, influence the opening forces. Furthermore, the plastisol sealing must adhere firmly to the end and show some flexibility so that it will not peel off from the end inside under the influence of the inside pressure which will considerably increase during pasteurization.

Therefore, the invention is based on the purpose of providing a can end from metal for cans whose contents is under inside pressure, specifically for cans for carbonated beverages of the type as mentioned above; a can end whose opening tabs, on the one hand, should be easy to open, but, on the other hand, should possess sufficient resistance to unintended opening, which provides a satisfactory and durable sealing and, in addition, is resistant to pasteurization. Furthermore, a method of producing an end of this kind shall be described.

The invention consists of the plastisol having a viscosity of $\eta_{D441s}-1$ (40° C.) of about 2000–2800 mPa.s and an edge angle $\alpha$ of about 30° to 40° before its application and gelation respectively, and, after the gelation, a tensile strength of 0.4 to 1.0 N/mm$^2$ and a maximum elongation of 120 to 250%, meaning that the viscosity is measured each time at a shearing speed of 441 s$^{-1}$ and at a temperature of 40° C. The edge angle is explained in more detail below with reference to FIG. 4).

If the tensile strength is within the range as stated of 0.4 to 1.0 N/mm$^2$, the opening tabs can, on the one hand, be opened with sufficient ease, on the other hand, they are held satisfactorily by the plastisol and the can inside pressure so to prevent unintended pushing down of the tabs. In this connection, it has been assumed that the can end as principally known, has an aperture of a larger diameter for pouring of about only 16.5 mm diameter and a smaller aperture for venting with a diameter of about 8 mm. The opening force of the larger opening tab of the pouring aperture would then amount to about 20–30 N, whereas the opening force of the smaller opening tab for the venting aperture should be about 15–20 N. With the inside pressure existing in carbonated beverage cans, this will ensure a favourable opening behaviour so that women and children will also be able to push down the opening tabs and so open the can. The lower limit of 15 N for the smaller opening tabs has been determined in order to prevent unintended self-opening of the tab. For ensuring a favourable opening behaviour during pushing down the tabs, especially the small tab, the maximum elongation should be within the range of 120–250%. In this connection, an opening distance of 0.6–0.8 mm has been chosen for the small tab. The opening distance is measured in the center of the tab on the diameter which is parallel to the hinge area of the tab. The opening distance means the amount by which the tab must be pushed down from its closed position to the can inside, until the plastisol sealing starts to tear off. As soon as the plastisol sealing has been torn, gas from the can inside can escape through the venting aperture, and the pressure will be balanced. Owing to this pressure balance, the large tab will no longer be under inside pressure and can, therefore, also be easily pushed down.

The viscosity $\eta$ shall be within the range as stated above so that part of the plastisol will penetrate between the edge of the opening tab and the edge of the aperture overlapping the same. Hereby—as explained below in more detail—air inclusions in the plastisol shall be avoided which might influence the tightness, and, in addition, the plastisol penetrating between opening tab and aperture edge shall set against the cutting edge of the aperture and cover it like a protective coating. Such a protective coating over the cutting edge will be an advantage, if the can end consists of steel sheet, such as tin or chromium coated steel sheet.

In order to achieve a permanent sealing by the plastisol applied, it is necessary for the plastisol coating to have a certain thickness. To obtain a sufficient coating thickness, the edge angle $\alpha$ shall be within the range of 30°–40°.

In producing the can end, a procedure will be useful of setting the degree of gelation of the plastisol and thus its tensile strength by selecting the gelation temperature and the gelation time (residence time at gelation temperature) so that the opening force of the opening tab of the pouring aperture will be about 20–30 N and that of the opening tab of the venting aperture about 15–20 N.

Preferably, the gelation temperature should then be about 160°–190° C. and the gelation time about 6–9 s.

In this process, the desired opening forces can be easily adjusted by selecting the gelation temperature and gelation time. Care should only be taken that the gelation conditions permit complete gelation of the plastisol so that the plasticizer will be bonded. The opening force could, though, also be varied by the amount of plastisol applied, but it would be more difficult to control the amount applied and, in addition, the plastisol cannot be applied in any arbitrary thickness. To obtain a long-time sealing effect, a certain coating thickness of the plastisol must be applied so that a reduction of the amount applied to reduce the opening force is not practicable. Moreover, the influence on the opening forces that can be achieved via the coating amount is comparatively low as compared to the influence by the gelation conditions.

Advantageous designs of the can end and other advantageous measures in the production of the same are characterized in the sub-claims.

Figure 2A:
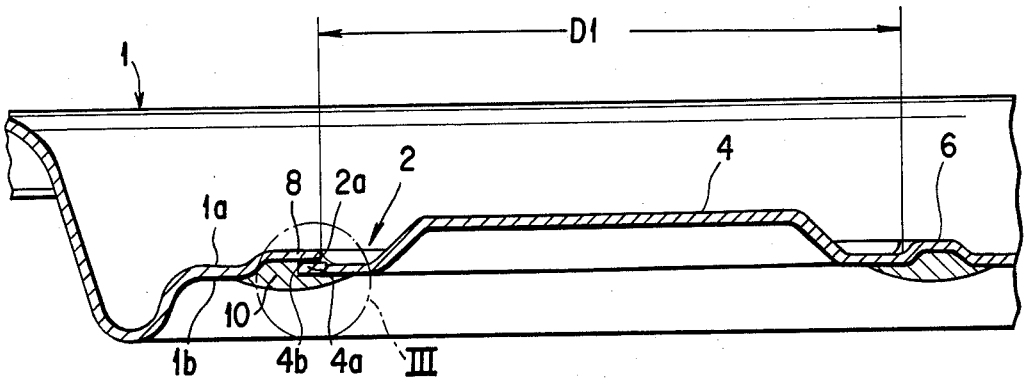
Figure 2B:
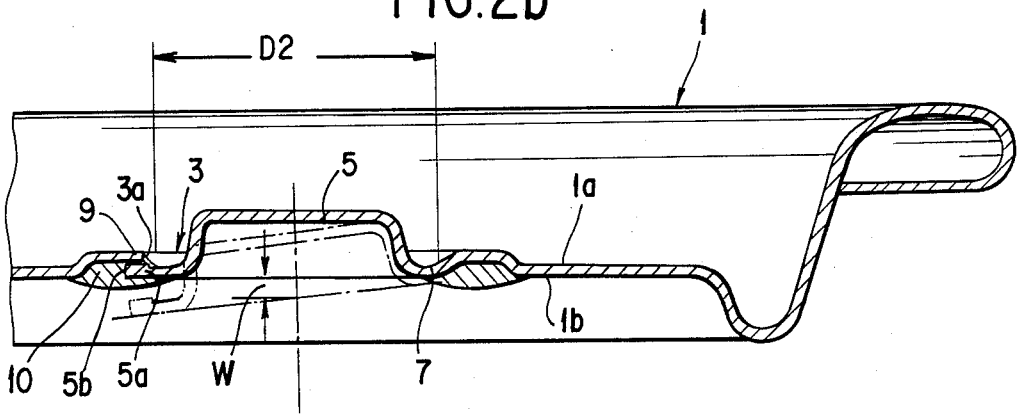

The invention will be explained in more detail by way of an example as shown in the drawing. There are:

FIG. 1: Overall view of the can end,

FIG. 2*a* and 2*b*: Cross sections of the can end in the area of the pouring aperture and the venting aperture respectively following the line II—II of FIG. 1, FIG. 3: Cross section in the edge area of opening tab and aperture at point III of FIG. 2*a*, FIG. 4: Picture to explain the edge angle, FIG. 5: Diagram of the opening forces as functions of the gelation temperature.

The can end 1 shown in the drawing is to be used for cans whose contents is under inside pressure, specifically for cans to be filled with carbonated beverages. The can end 1 consists of metal sheet, preferably steel sheet, which has been suitably tin or chromium coated. The can end 1 has two apertures of different diameters, of which the larger aperture has been called pouring aperture 2 and the aperture with the smaller diameter venting aperture 3. The diameter D1 of the pouring aperture 2 is about 16.5 mm, whereas the diameter D2 of the venting aperture is about 8 mm. Each of the two apertures 2, 3 is normally closed by an opening tab 4, 5. The opening tabs 4, 5 have been formed from the actual end 1. For forming each of the two opening tabs 4, 5, a bulge directed upwards is first produced by cold forming. This bulge is partly punched with a remaining hinge area 6, 7 which connects the relative tab 4, 5 to the residual end 1*a*. After punching the tab 4, 5, its edge is slightly pushed down in relation to the end 1 so that its edge area 4*a* and 5*a* respectively will be positioned below the edge area 8, 9 surrounding the aperture 2, 3. By lowering the height level of the edge area 8, 9 of apertures 2, 3 and/or by reducing the height of the opening tabs 4, 5 formed similar to a cap, the diameters of the apertures 2, 3 will be reduced or the diameters of the opening tabs 4, 5 will be increased resulting in the edge area 8, 9 of the can end surrounding apertures 2, 3 overlapping the edge area 4*a*, 5*a* of the two opening tabs 4, 5 from the outside of the can end 1*a*. The can end outside 1*a* means that side of the can end 1 which will be the outside of the finished can, whereas the can end inside 1*b* will be facing the inside of the can.

In order to seal the opening tab 4, 5 from end 1 and to further prevent unintended pushing down of opening tabs 4, 5, plastisol 10 will be applied to the edge areas 4*a*, 5*a* of the tabs 4, 5 and to the edge areas 8, 9 of the end on the end inside 1*b* as sealant which jellies under the effect of heat. This plastisol 10 must meet certain specifications so that it can fulfil the requirements as requested.

So, the liquid, but not jellied plastisol should have a viscosity of 2000 to 2800 mPa.s at a shearing speed of $D_{441s}-1$ and at a temperature of 40° C. The viscosity $\eta$ shall be within the range as stated so that—as will be explained below—part of the plastisol can partially penetrate through a gap formed between the edge areas 4*a*, 5*a* and 8, 9 respectively of the opening tabs 4, 5 and apertures 2, 3 respectively.

The liquid plastisol 10 will be applied from below through a ring nozzle according to the process described in DE-PS No. 24 21 315. In this process, the can end will be moved towards the nozzle and brought into contact with the plastisol. Subsequently, the end will be lifted again from the application nozzle hereby taking along part of the plastisol from the end. During lifting the end from the nozzle, a plastisol hose will be formed which will tear off after a certain lifting distance. In order to here reach a favourable tearing behaviour, the plastisol should contain anorganic fillers with an average grain size in the range of about 60–100 μm. The amount of organic fillers should represent about 50% by weight of the total amount of plastisol, with the remaining amount consisting of PVC and plasticizers.

As a filler, it will be appropriate to use a mixture of aluminum oxide and barium sulphate, the latter of which should have a smaller grain size and the aluminum oxide a larger grain size. By the addition of barium sulphate, the occurrence of air inclusions in the plastisol can be avoided. The weight ratio of barium sulphate to aluminum oxide should be about 1:5 to 1:3, preferably about 1:4.

In the following, a suitable plastisol composition will be stated as an example, with all data given in % by weight:

| | Range | Preferred |
|---|---|---|
| Plasticizer (dioctyl phtalate) | 30–38 | 31 |
| PVC | 15–23 | 21 |
| Al | 10–15 | 14 |
| Ba | 2–6 | 4 |
| Ca | 0.1–0.5 | 0.3 |
| $SiO_2$ | 0.1–0.5 | 0.2 |
| Fe | <0.1 | |
| $SO_4^{2-}$ | 1–5 | 3 |
| $H_2O$ | <0.1 | |

In order to obtain a permanent sealing, plastisol 10 must have a certain coating thickness d. This coating thickness d should amount to about 0.3 mm, measured perpendicular to the end surface on the periphery 4*b* and 5*b* respectively of opening tabs 4 and 5 respectively. This should be ensured by the edge angle $\alpha$ being 30°–40°.

Figure 4:
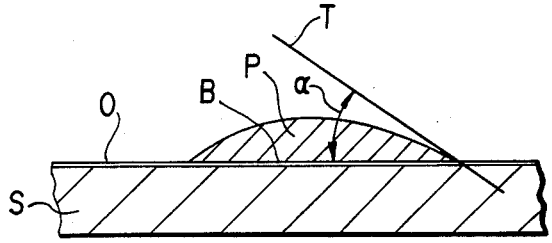

Based on FIG. 4, the definition of this edge angle shall now be explained. The edge angle $\alpha$ is determined by applying a drop P of liquid plastisol to a plane surface corresponding exactly to the surface of end 1 on its inside 1*b*. For representing this surface, it will be appropriate to use a piece of tin or chromium coated steel sheet S which, on its one side, is provided with a coating O of an organosol. End 1, too, has been produced from such a metal which has such an organosol coating on the side later to be inside 1*b*. The plastisol drop P applied to the organosol coating O will take a dome-shaped form. The angle included by a tangential plane T to the surface of the plastisol drop P and by its base B is called edge angle $\alpha$.

As already mentioned above, the forces needed to open the larger opening tab 4 of the pouring aperture 2 should be 20 to 30 N and the opening forces required to open the smaller opening tab 5 of the venting aperture 3 should be about 15–20 N. To attain this purpose, the tensile strength of the plastisol must be within the range of 0.4–1.0 N/mm². A method of advantageous adjustment of this tensile strength will be explained below in more detail.

For ensuring a favourable opening behaviour in pushing down the opening tabs 4, 5 and particularly the smaller opening tab 5, the maximum elongation should be within the range of between 120–250%. The opening distance b which is measured in the center of opening tab 5 should be approximately between 0.6–0.8 mm. Opening distance b is the distance which is covered from the center of tab 5 up to the initial tearing of the plastisol. In case of an excessive opening distance, venting of the container through the small opening tab 5 will not be guaranteed, since, then, the cap of the tab will completely plunge into the aperture 3, and a finger pushing the tab 5 will no longer be able to follow. If the opening distance is too short, there will be the danger of the plastisol sealing 10 tearing off already after just tipping the opening tab 5 and thus opening the can without intending to do so.

In punching the opening tabs 4, 5 from end 1, cutting edges will occur on the periphery **4*b*, 5*b* of opening tabs 4, 5 and on the periphery 2*a* and 3*a* respectively of aperture 2 and 3** respectively.

Figure 3:
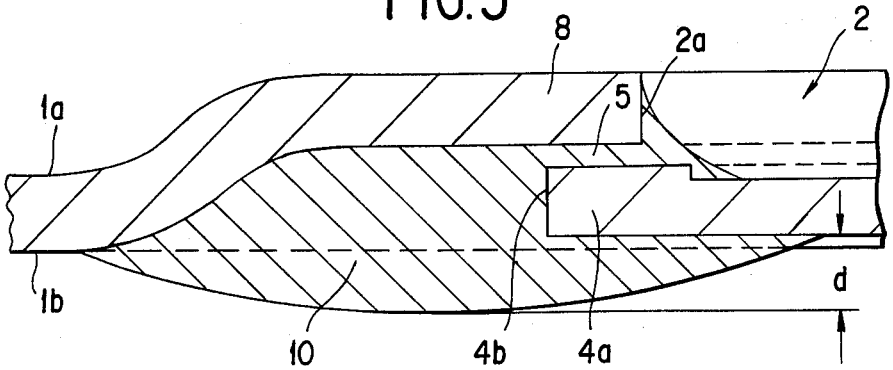

If tin or chromium coated steel sheet is used for producing the can end 1, these cutting edges are no longer protected from corrosion. It is the task of the plastisol 10 to also cover these cutting edges and to protect them from corrosion. A gap s of about 0.05 to 0.1 mm is appropriately provided between the overlapping surfaces, facing each other, of the edge areas **4*a*, 5*a* and 8, 9 respectively of tabs 4, 5 and apertures 2, 3. Through this gap, plastisol applied to the inside 1*b* of the end will penetrate and then, as shown in FIG. 3, also set against the cutting edge 2*a*, 3*a* of apertures 2, 3**.

The amount of plastisol penetrated through gap s should amount to about 2–6 mg at the pouring aperture and to about 1–3 mg at the venting aperture. The total amount of plastisol 10 applied amounts to about 85 mg at the pouring aperture 2 and to about 35 mg at the venting aperture.

Figure 5:
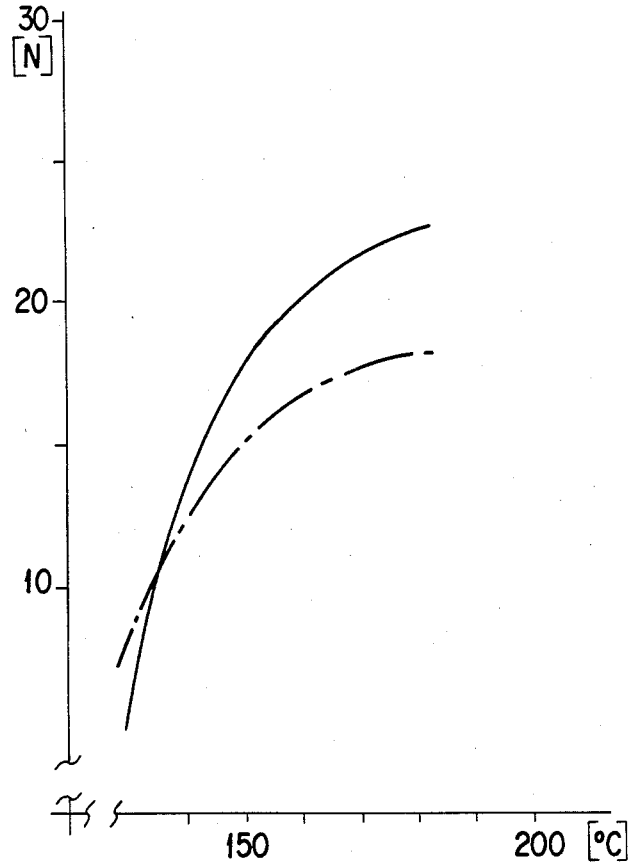

In producing the can end, the degree of gelation of the plastisol and, so, its tensile strength is adjusted by the selection of the gelation temperature so that the opening force at opening tab 4 of the pouring aperture 2 will be about 20–30 N and at opening tab 5 of the venting aperture 3 about 15–20 N. To attain this purpose, the gelation temperature should be about 160°–190°. FIG. 5 shows the opening force as a function of the gelation temperature, i.e. in a full line for the large opening tab 4 and in a dash-dotted line for the small opening tab 5. The opening forces were each measured when tin coated steel sheet was used.

The gelation temperature is usefully produced by infrared radiation. If the radiation sources for the infrared radiation are left unchanged, the gelation temperature can be adjusted by passing the end coated with plastisol through the oven for gelation at a higher or lower speed. So, with a residence or gelation time in the oven of 6 sec, a gelation temperature of about 160° C. can be reached, whereas, with a residence time of 8 sec, the temperature will increase to 190° C.

As already mentioned above, it will be useful to apply the plastisol from below to the inside **1*b* of can end 1** arranged horizontally, and then, in this position, the end is transported through the gelation oven resulting in the plastisol forming a bead of the desired thickness due to the force of gravity. If the arrangement is reversed, there is the danger of the plastisol escaping laterally due to the force of gravity and of the coating thickness then being insufficient for ensuring a permanent sealing.

Furthermore, it will be useful if, during plastisol application, the mutually facing overlapping surfaces of the edge areas **4*a*, 5*a* and 8, 9 respectively of opening tabs 4, 5 and of apertures 2, 3 are placed apart in order to provide, between the two edge areas, a gap for the penetration of part of the plastisol. This gap may, for example, be produced by pushing down the opening tabs 4, 5 during plastisol application by means of a spring pin or a similar device. The gap width may then amount to 0.2–0.3 mm. Such a gap will have several advantageous effects, namely, during plastisol application, air trapped between the plastisol and the end inside can escape through the gap, thus avoiding air inclusions in the plastisol. In addition, the plastisol penetrates through the gap and, so, also covers the cutting edges 2*a*, 3*a* of apertures 2, 3. This penetrated plastisol will then represent a corrosion protection for the cutting edges. Moreover, the plastisol filling the gap will prevent air entering again from the end outside 1*a* to the end inside 1*b* between plastisol application and complete gelation of the plastisol. Such an entrance of air could occur due to tabs 4, 5 vibrating in relation to the remaining part of the end during transport from the plastisol application station to the gelation oven, thus resulting in a pumping effect between the edge areas of the opening tabs and of the apertures. If, after plastisol application, the pressure on the opening tabs 4, 5** is released, the gap will be reduced again to a size of 0.05–0.1 mm due to the elasticity of the hinge area.

In order to avoid direct contact of the contents of the can with the metallic coating of the end, the inside of the end is usefully provided with an organosol coating. It is common practice to apply such an organosol coating to the metal sheet which is used for the production of can ends. However, it is useful to provide the end inside with an organosol coating whose melting temperature is just below the gelation temperature of the plastisol. With gelation temperatures of the plastisol of 160°–190° C., the melting temperature of the organosol should be about 150°. Hereby, minor damages to the organosol coating which may occur during punching and forming of the opening tabs and their surrounding areas of the end will be repaired, i.e. if the end is heated in the gelation oven, the organosol coating will simultaneously melt and, so, possible micro-cracks will be closed.

Before gelation, a coating may alternatively be applied to the end outside **1*a* at least within the area of apertures 2, 3. This coating will cover the cutting edges 2*a*, 3*a* of apertures 2, 3**. It may be applied either in the form of a stripe across the end so that both apertures will be covered by the coating, or the coating can be applied in ring-form by means of a ring nozzle, or in a way similar to the plastisol application. It is useful to apply an acrylic resin coating to the end outside. Drying of this repair coating will then also be made in the gelation oven.

To improve adhesion of the plastisol to the cutting edges of aperture and tab and also the corrosion protection, it is useful to apply, before plastisol application, a primer to the edge areas of opening tab and aperture, in particular to their cutting edges. Here, again, it will be advantageous, if the primer is sprayed on by means of a ring nozzle or is stamped on in a way similar to the plastisol, as it is, for example, described in DE-PS No. 24 21 315.

We claim:

1. A can end made from metal for cans whose contents is under inside pressure, specifically for cans to be filled with carbonated beverages, with at least one opening tab partly punched from the end leaving a hinge area, and an aperture belonging to it formed by the partial punching, with the opening tab and/or the area of the end surrounding the aperture being cold formed so that the edge area of the aperture overlaps the edge area of the opening tab on the outside of the end, and with plastisol as a sealant being applied in ring-form to the edge areas of the opening tab and of the aperture on the end inside and having jellied under heat; characterized by the plastisol (10) having a viscosity of $\eta_{D441s}-1$ (40° C.) of about 2000–2800 mPa.s and an edge angle $\alpha$ of about 30°–40° before application and gelation respectively and, after gelation, having a tensile strength of 0.4–1.0 N/mm$^2$ and a maximum elongation of 120–250%.

2. A can end according to claim 1, characterized by the plastisol containing anorganic fillers with an average grain size in the range of about 60–100 μm.

3. A can end according to claim 1 or 2, characterized by the plastisol containing about 50% by weight of anorganic fillers.

4. A can end according to claim 2 or 3, characterized by the plastisol containing, as a filler, a mixture of aluminum oxide and barium sulphate.

5. A can end according to claim 4, characterized by the weight ratio of barium sulphate to aluminum oxide being about 1:5 to 1:3, preferably about 1:4.

6. A can end with a pouring aperture of a larger diameter and a smaller venting aperture according to claim 1; characterized by the tensile strength and the coating thickness (d) of the plastisol being chosen so that the opening force at opening tab (4) of pouring aperture (2) will be about 20–30 N and the opening force at opening tab (5) of venting aperture (3) will be about 15–20 N, with the opening forces each being measured without counter-pressure.

7. A can end according to claim 6, characterized by diameter (D1) of pouring aperture (2) being about 16.5 mm and the diameter (D2) of the venting aperture (3) being about 8 mm.

8. A can end according to claim 6, characterized by the coating thickness (d) of plastisol (10) on the periphery (4*b*, 5*b*) of opening tab (4, 5), measured perpendicular to the end surface, amounting to about 0.3 mm.

9. A can end according to claim 1, characterized by a gap (s) of about 0.05–0.1 mm filled with plastisol (10) being provided between the mutually facing overlapping surfaces of the edge areas (4*a*, 5*a*; 8, 9) of opening tabs (4, 5) and apertures (2, 3).

10. Can end according to claim 9, characterized by the cutting edge (2*a*, 3*a*), formed by punching the opening tab (4, 5) and limiting the aperture, being covered by plastisol (10) which has penetrated through gap (s).

11. Can end according to claim 10, characterized by the amount of plastisol penetrated through gap (s) being about 2–6 mg at the pouring aperture (2) and about 1–3 mg at the venting aperture (3).

12. Can end according to claims 6–11, characterized by the coating weight of the plastisol (10) amounting to about 85 mg at pouring aperture (2) and to about 35 mg at venting aperture (3).

13. Can end according to claim 1, characterized by the can end (1) being provided on its inside (1*b*) with a coating of a thermoplastic synthetic material, whose melting temperature is just below the gelation temperature of the plastisol (10).

14. Can end according to claim 13, characterized by the melting temperature of the coating of synthetic material amounting to about 150° C.

15. Can end according to claim 13 or 14, characterized by the coating of synthetic material consisting of an organosol.

16. A method for producing a can end from metal according to at least one of the preceding claims, characterized by the degree of gelation and, thus, its tensile strength being adjusted by choosing the gelation temperature so that the opening force at the opening tab of the pouring aperture amounts to about 20–30 N and at the opening tab of the venting aperture to about 15–20 N.

17. A method according to claim 16, characterized by the gelation temperature amounting to about 160°–190° C.

18. Method according to claim 16, characterized by the mutually facing overlapping surfaces of the edge areas of the opening tabs and of the apertures being taken apart during plastisol application in order to provide a gap between the two edge areas for part of the plastisol to penetrate through down to the cutting edge of the aperture.

19. Method according to claim 16, characterized by an organosol coating being applied to the end inside, preferably to the metal to be used for the production of the end, before the plastisol application, with its melting temperature being just below the gelation temperature of the plastisol.

20. Method according to claims 17 and 19, characterized by the melting temperature of the organosol coating amounting to about 150° C.

21. Method according to claim 16, characterized by applying, before the gelation, a coating to the end outside, at least within the area of the apertures, which will cover the cutting edge(s) of the aperture(s) and by drying this coating during gelation.

22. Method according to claim 21, characterized by an acrylic resin coating being applied to the end outside.

23. Method according to claim 16 or 21, characterized by the plastisol being applied from below to the inside of the horizontally positioned can end and by the end in this position being then transported through a gelation oven.

24. Method according to claim 16, characterized by the gelation temperature being generated by infrared radiation.

25. Method according to claim 16 or 19, characterized by a primer being applied before the plastisol application to the edge areas of the opening tab and the aperture, particularly to their cutting edges.

26. Method according to claim 25, characterized by the primer being sprayed on by means of a ring nozzle or stamped on.

* * * * *